US006960040B2

(12) United States Patent
D'Alessio et al.

(10) Patent No.: US 6,960,040 B2
(45) Date of Patent: Nov. 1, 2005

(54) PACKAGE ASSEMBLY WITH APPLICATOR AND CONTAINER FOR ADHESIVE MATERIALS

(75) Inventors: Keith R. D'Alessio, Cary, NC (US); Gary F. Prokop, Wheaton, IL (US); Leonard F. Czuba, Lombard, IL (US); Carl E. Behrend, Chicago, IL (US); Peter J. Kopec, Park Ridge, IL (US)

(73) Assignee: Closure Medical Corporation, Raleigh, NC (US)

( * ) Notice: Subject to any disclaimer, the term of this patent is extended or adjusted under 35 U.S.C. 154(b) by 0 days.

(21) Appl. No.: 10/611,921

(22) Filed: Jul. 3, 2003

(65) Prior Publication Data

US 2004/0026282 A1 Feb. 12, 2004

Related U.S. Application Data

(62) Division of application No. 09/987,116, filed on Nov. 13, 2001, now abandoned, which is a division of application No. 09/145,200, filed on Sep. 1, 1998, now Pat. No. 6,372,313.

(51) Int. Cl.[7] ..... A46B 11/00
(52) U.S. Cl. ..... 401/125; 401/123; 206/205
(58) Field of Search ..... 401/123, 118, 401/124, 125, 130; 206/205, 210

(56) References Cited

U.S. PATENT DOCUMENTS 3,146,806 A 9/1964 Ginsburg
3,315,689 A 4/1967 Melik
3,559,652 A 2/1971 Banitt et al.

(Continued)

FOREIGN PATENT DOCUMENTS

| | | |
|---|---|---|
| DE | 196 42 286 A1 | 4/1998 |
| EP | 0 402 140 A1 | 12/1990 |
| EP | 0 779 229 A1 | 6/1997 |
| EP | 0 857 658 A1 | 8/1998 |
| WO | WO 92/12863 | 8/1992 |
| WO | WO 97/31598 | 9/1997 |
| WO | WO 98/23220 | 6/1998 |

*Primary Examiner*—David J. Walczak
(74) *Attorney, Agent, or Firm*—Hutchison & Mason PLLC

(57) ABSTRACT

A package assembly or kit can be used in conjunction with storing and dispensing adhesive materials. The package assembly can include an enclosure in which an applicator and a container may be positioned. The container contains adhesive material. The enclosure may include a base and a cover. The base preferably includes one or more cavities, with at least one applicator disposed in one of the cavities. Further, the container may be disposed in another of the cavities. The cover may be provided with a plurality of wells. The container may include a restrictor positioned within a neck of the container. The restrictor is provided to limit the volume of adhesive material retained in an absorbent end of an applicator such as a swab. The package assembly can be provided in a sterilized condition.

4 Claims, 8 Drawing Sheets

U.S. PATENT DOCUMENTS

D221,035 S 6/1971 Raines
3,667,472 A 6/1972 Halpern
3,704,089 A 11/1972 Stehlik
3,759,375 A 9/1973 Nappi
3,976,195 A 8/1976 Cohen
4,035,334 A 7/1977 Davydov et al.
4,294,349 A 10/1981 Ibsen et al.
4,364,473 A 12/1982 Bogaert
4,430,013 A 2/1984 Kaufman
4,501,363 A 2/1985 Isbey, Jr.
4,724,177 A 2/1988 Russo et al.
4,726,553 A 2/1988 Wischusen, III
4,767,398 A 8/1988 Blasius, Jr.
4,786,534 A 11/1988 Aiken
4,789,639 A 12/1988 Fleming
4,802,797 A 2/1989 Cole
4,854,759 A 8/1989 Morane et al.
4,869,381 A 9/1989 Agner
5,106,297 A 4/1992 Discko, Jr.
5,123,431 A 6/1992 Wilson
5,240,415 A 8/1993 Haynie
D344,412 S 2/1994 Barnhart
5,308,180 A 5/1994 Pournoor et al.
5,333,737 A 8/1994 Clark
5,370,221 A 12/1994 Magnusson et al.
5,378,226 A 1/1995 Hanifl et al.
5,403,591 A 4/1995 Tighe et al.
5,456,361 A 10/1995 Walsh et al.
5,474,206 A 12/1995 Herring, Sr.
5,480,935 A 1/1996 Greff et al.
5,490,737 A 2/1996 Gueret
5,525,647 A 6/1996 Eichmiller
5,530,037 A 6/1996 McDonnell et al.
5,575,997 A 11/1996 Leung et al.
5,580,565 A 12/1996 Tighe et al.
5,582,834 A 12/1996 Leung et al.
5,597,254 A 1/1997 Vasas
5,599,125 A 2/1997 Vasas et al.
5,653,769 A 8/1997 Barley, Jr. et al.
5,660,273 A 8/1997 Discko, Jr.
5,697,720 A 12/1997 Lhuisset
5,709,866 A 1/1998 Booras et al.
5,779,053 A 7/1998 Partika et al.
5,900,245 A 5/1999 Sawhney et al.
5,909,976 A 6/1999 Maeda
5,928,611 A * 7/1999 Leung ..... 422/131
6,000,575 A 12/1999 LaCour et al.
6,217,603 B1 * 4/2001 Clark et al. ..... 606/214
6,386,781 B1 5/2002 Gueret

* cited by examiner

PACKAGE ASSEMBLY WITH APPLICATOR AND CONTAINER FOR ADHESIVE MATERIALS

This is a Divisional of application Ser. No. 09/987,116 filed Nov. 13, 2001, now abandoned, which is a Divisional of application Ser. No. 09/145,200 filed Sep. 1, 1998 (now U.S. Pat. No. 6,372,313). The entire disclosure of the prior application is hereby incorporated by reference herein in its entirety.

BACKGROUND OF THE INVENTION

1. Field of Invention

This invention relates to a package assembly for adhesive materials.

2. Description of Related Art

Adhesive materials are conventionally stored in a storage tube or other similar device that includes a dispensing tip. Illustratively, U.S. Pat. No. 4,364,473 to Bogaert discloses an adhesive material stored in a tube. The storage tube may be constructed of an elastic or resilient material, such that the storage tube is squeezed to decrease the interior volume of the tube. When a user wants to apply a portion of the adhesive on a surface, the user positions the dispensing tip adjacent to or on the surface. The user then squeezes the tube to force a quantity of the adhesive material out. The adhesive flows out of the tube and onto the surface. However, there are various drawbacks to this arrangement, especially with applications of certain types of adhesives and applications of adhesives in certain environments.

Illustratively, it is difficult to apply adhesives with low viscosity using conventional devices. If the low viscosity adhesive is stored in a tube the user will squeeze the tube to dispense a quantity of the adhesive. However, it is difficult to squeeze the tube such that the correct amount of adhesive is dispensed. It is often the case that the tube is squeezed too much and a large quantity of the adhesive is dispensed. As a result, the adhesive may flow into areas to which the user did not intend to apply the adhesive. This results in possible damage to the surface as well as the necessity for the user to take away the excess adhesive. In turn, this also results in waste of the adhesive product.

An alternative approach to applying an adhesive is to initially apply the adhesive onto an applicator and then onto the surface. One example of this is disclosed in U.S. Pat. No. 5,333,737 to Clark. In such an approach, a user squeezes the tube, for example, containing the adhesive so as to apply a portion of the adhesive onto the applicator. The applicator is then moved into physical contact with the surface so that a portion of the adhesive is applied to the surface. However, with low viscosity adhesives, the adhesive may run off the applicator before it is adjacent the surface. This results in both waste of the adhesive and in possible harm, since excess adhesive may be deposited in an area where it is not wanted.

Further, a problem arises if the tube of adhesive is to be used more than once, as is common. If a user chooses to apply the adhesive directly from the tube onto the surface, and not to use an applicator, the dispensing tip may contact the surface upon which the adhesive is being applied. Over multiple uses, contaminants may be transferred from one surface to another surface. As is apparent, this is especially of concern with the application of adhesives in the medical field.

Further, there are other problems associated with conventional techniques with the application of adhesives in certain environments, such as environments in which the surface is difficult to reach or isolated. If a user wishes not to use an applicator, it is necessary for the dispensing tip of the tube to be adjacent to or on the surface. However, the tube may not easily fit within the spatial constraints in which the surface is located. As a result, the spatial constraints may limit applications using only the tube and force a user to use an applicator. This raises a further problem in that an appropriate applicator may not be conveniently available.

Accordingly, conventional devices fail to address the various drawbacks discussed above, as well as others. As described above, U.S. Pat. No. 4,364,473 to Bogaert discloses a tube containing an adhesive material. More specifically, Bogaert is directed to an arrangement for repairing a dental prosthesis including a package containing the tube of adhesive, bottles containing a monomer and a polymer and a support. Bogaert teaches using the tube to apply the adhesive directly on the prosthesis. This raises concerns of contamination as described above. Further, the tube of Bogaert would not be usable in some situations where there are spatial constraints and the tube could not be effectively maneuvered so as to apply the adhesive.

Accordingly, known devices do not effectively address the drawbacks described above, as well as others. Conventional devices fail to provide an applicator that is optimized for convenient dispensing and application of adhesive materials on a variety of surfaces and structures.

SUMMARY OF THE INVENTION

An object of the invention is to address the need for an easy to use and efficient package assembly for dispensing and applying an adhesive material, preferably a medical adhesive.

Also, the invention is directed to the application of monomer compositions and polymers formed therefrom, in industrial and home applications, for example in bonding rubbers, plastics, wood, composites, fabrics, and other natural and synthetic materials. Included among these adhesives are the 1,1-disubstituted ethylene monomers and polymers, such as the α-cyanoacrylates. Since the discovery of the adhesive properties of such monomers and polymers, they have found wide use due to the speed with which they cure, the strength of the resulting bond formed, and their relative ease of use. These characteristics have made the α-cyanoacrylate adhesives the primary choice for numerous applications such as bonding plastics, rubbers, glass, metals, wood, and, more recently, biological tissues. The invention provides an easy and efficient approach to apply these adhesives.

In particular, the invention provides a package assembly or kit to hold and apply an adhesive material conveniently, inexpensively and effectively. The kit includes an enclosure which contains at least one container of adhesive material and at least one applicator. The applicator includes at least one absorbent portion for absorbing adhesive to be applied.

In embodiments of the invention, the enclosure includes separate compartments. A plurality of applicators are contained within the enclosure. In some embodiments, each of the applicators includes a shaft having two ends and an absorbent portion at each end of the shaft. The two absorbent portions may be differently configured for wiping and drying a surface to be treated, and for applying adhesive, respectively. Separate compartments are provided for holding at least one container and the applicators. A plurality of the applicators is held within one or more of the separate compartments. Further, in embodiments separate compartments holding the applicators may be separable from the enclosure.

In embodiments, the enclosure includes a base and a cover. The cover has a surface facing an interior of the enclosure when the enclosure is closed, with wells disposed on the surface. The wells are configured to hold an adhesive material dispensed from a container when the enclosure is open. The enclosure may include at least the same number of the wells as a number of the applicators.

In embodiments of the invention, the container includes an internal lumen, a closable opening, and a bottom portion. The container is configured to be self-supportable on the surface with the opening facing upwardly. A restrictor may extend into the internal lumen of the container and define the opening of the container. The bottom portion of the container and a suction cup are configured to be connected together. The suction cup holds the container to the surface. The opening of the container and an applicator are configured to allow at least an absorbent portion of the applicator to pass through the opening into the container and to compress the absorbent portion.

BRIEF DESCRIPTION OF THE DRAWINGS

Embodiments of this invention will be described in detail with reference to the following figures, wherein.

DETAILED DESCRIPTION OF PREFERRED EMBODIMENTS

Figure 2:
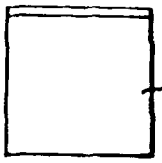
FIG. 2 is a top plan view showing the package of FIG. 1.

This invention is directed to a package assembly or kit which contains a container of adhesive as well as an applicator. The package assembly in accordance with the invention may be utilized in conjunction with a wide variety of adhesive materials. Further, the package assembly according to this invention can be used in conjunction with a wide variety of applications of adhesive material, wherein it is necessary or desirable to efficiently and easily apply an adhesive material. For example, the package assembly in accordance with the invention may be used to apply monomeric adhesive compositions, such as an adhesive for the treatment of surgically incised or traumatically lacerated tissues; retarding blood flow from wounds; dressing burns; dressing skin or treating stomatitis or other superficial or surface sores or wounds. The package assembly may also be used to apply various adhesives including 1,1-disubstituted ethylene monomers and polymers, such as the α-cyanoacrylates. The assembly in accordance with the invention may be used to store and dispense a variety of adhesives. Examples include, but are not limited to, those applicable to medical, industrial, and home use. Especially useful liquids include polymerizable liquid adhesives, such as the adhesives described in copending U.S. patent application Ser. Nos. 09/099,457 and 08/488,411, the disclosures of which are hereby incorporated by reference in their entireties. As used herein, "adhesive" or "adhesive material" includes, but is not limited to a monomeric formula or a monomeric composition that is reacted or unreacted. For example, in the invention adhesive is intended to encompass a monomeric formula that polymerizes when applied to the surface of the skin.

One particular application of the package assembly of the invention is in conjunction with the storage and application of adhesive materials for medical or surgical procedures. However, it should be appreciated that any known or later developed adhesive material can be used in conjunction with the invention.

A package assembly or kit in accordance with the invention includes an enclosure. The enclosure contains at least one container and at least one applicator. The container contains an adhesive material. The applicator includes at least one absorbent portion. The enclosure may be any of a variety of shapes and designs dependent on numerous factors including the specific contents of the enclosure and the intended use of the adhesive contained within the enclosure, for example.

In embodiments, the enclosure includes a base and a cover for the base. The base includes one or more applicator cavities for holding and retaining one or more applicators. The base may further include a container cavity for holding and retaining the container of adhesive material. The cover is preferably movably connected to the base. For example, the cover may be removable or may be pivotably attached to the base using a line of weakness or hinges separating the cover from the base.

In embodiments, the cover or base, but preferably the cover, includes a plurality of wells formed on its surface. The wells may temporarily hold small quantities of the adhesive material into which the absorbent portion of the applicator may be dipped (dip wells), or can catch and retain drops resulting from application of the adhesive material to the applicator (drip wells).

In embodiments, the base includes a facing surface. The cover is pivotable between a first position and a second position. In the first position, the cover surface opposes the facing surface of the base. In the second position, the cover surface faces in the same direction as the facing surface of the base. In such a manner, the wells that are disposed in the cover are exposed for use when the cover is in the second position.

In embodiments, applicator cavities are positioned in the base and have an elongated shape. In preferred embodiments, the base includes two applicator cavities and a single container cavity. The two applicator cavities may be positioned side by side. A plurality of applicators may be positioned in a single applicator cavity. For example, the applicators may be stacked within a single applicator cavity.

In embodiments, the enclosure includes one or more applicator cavities that may be separated along a breaking line. The breaking line may be weakened and broken in some manner, such as by a perforation. As a result, the respective cavity portions and associated applicators may be easily separated from each other.

In embodiments, applicator cavities for respective individual applicators are positioned in a holding portion of the package assembly. The applicator cavities may be shaped to match the shape of the applicators. For example, a first well may be positioned at the first end of the applicator cavity, a second well at the second end of the applicator cavity, and a connection portion may extend between the first well and the second well. This provides a neat and predictable location for the applicators and the applicator cavities themselves may act as dip or drip wells. This is particularly advantageous in embodiments where the applicator cavity portions may be separated from the rest of the enclosure and discarded after use.

In further embodiments, the container may include a vessel portion and a neck. A restrictor is positioned and supported in the neck of the container. The restrictor includes a passage extending between ends and along the length of the restrictor. The restrictor may be formed of any suitable material that is compatible with the adhesive, such as resilient plastics material, for example.

An absorbent end of an applicator may be passed through the restrictor into the receptacle. Provided there is sufficient adhesive material contained in the receptacle, the absorbent end of the applicator will absorb a portion of the adhesive material. Thereafter, the applicator including the absorbent end is withdrawn from the receptacle and is withdrawn back through the restrictor. The restrictor diminishes the size of the absorbent end, i.e., compresses and wipes the absorbent end of the applicator. As a result, the volume content of adhesive material retained within the absorbent end of the applicator is both limited and controlled. Use of the wells with such embodiments is therefore optional. In addition, the restrictor extending into the container can reduce or prevent spillage when the container is tipped.

Further, in embodiments, the container includes a base connected to its lower portion. In embodiments, the base may include a center support and a suction cup. The suction cup is positioned on a lower portion of the center support and can hold the container in place to permit one-handed application of the adhesive. The base may also include at least one extension or stabilizer for supporting the container against tipping on the suction cup. The extension may, for example, comprise a skirt. The skirt is annular in shape and defines a skirt interior space. The base may be integrally formed with or reversibly attached to the container.

In embodiments, the container base further includes a locking retainer integrally formed with or reversibly attached to the skirt. The locking retainer defines a receiving cavity having an interior in which the container is positionable. The receiving cavity is substantially circular in shape and includes an interior surface. The interior surface of the receiving cavity includes a locking channel defined therein. A locking ring disposed on an exterior surface of the container is matingly engageable with the locking channel.

The package assembly including an applicator and a receptacle in accordance with the invention offers a user simple and effective storage and application of an adhesive. The simplicity of the package assembly requires little or no instruction prior to its use. Further, the construction of the package assembly in accordance with the invention includes a limited number of moving parts. The package assembly may be utilized easily and effectively in a wide variety of environments and in an expeditious manner.

The invention will be further described in conjunction with the accompanying figures showing exemplary embodiments of the invention. In the figures, like numerals have been used to identify like components.

Figure 1:
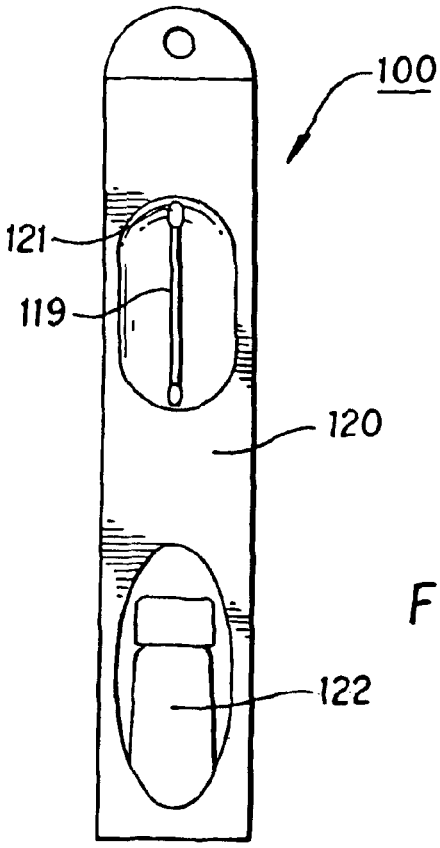
FIG. 1 is a side plan view of a container and applicator positioned in an enclosure of the invention.

FIGS. 1 and 2 show a package assembly or kit 100 in accordance with the invention to hold and apply an adhesive material conveniently, inexpensively and effectively. The kit includes an enclosure 120. The enclosure 120 contains at least one container 122, which contains an adhesive material, and at least one applicator 119. The applicator 119 includes at least one absorbent portion 121. The enclosure 120 may be any of a variety of shapes and designs dependent on numerous factors including the specific contents of the enclosure and the intended use of the adhesive contained within the enclosure, for example.

When a user wants to apply the adhesive to a surface, for example, the user opens the enclosure 120 and removes an applicator 119 and container 122 from enclosure 120 (thus exposing the exterior surface of the absorbent portion of the applicator to atmosphere prior to applying the adhesive material to the exterior surface). Thereafter, the user may drip, for example, an amount of the adhesive onto the absorbent portion 121 of the applicator or may dip the absorbent portion of the applicator into the adhesive in the container. Then, the absorbent portion 121 is moved so as to make physical contact with the surface upon which the adhesive is to be applied. When physical contact is made, the absorbent portion 121 will be compressed. As a result, adhesive will be released from the absorbent portion 121 onto the surface.

Figure 3:
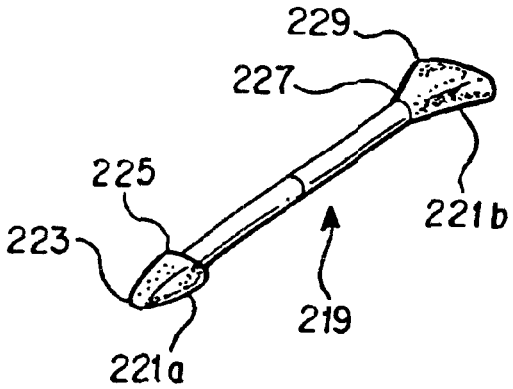
FIG. 3 is a perspective view showing an applicator in accordance with embodiments of the invention.

For example, an applicator in accordance with embodiments of the invention may be constructed as shown in FIG. 3. FIG. 3 shows an applicator 219 in accordance with embodiments of the invention. The applicator 219 includes a first absorbent end 221*a* and a second absorbent end 221*b*. The absorbent ends 221 may be constructed of absorbent foam or fibrous pad material, for example. The absorbent end 221*a* in FIG. 3 is tapered such that the tip 223 of the absorbent end is smaller in dimension than the base 225. The absorbent end 221*b* is tapered such that the tip 229 of the absorbent end is wider in dimension than the base 227. Further, the tip 229 of the absorbent end 221*b* is wider than the base 225 of the absorbent end 221*a*. Such a construction can be useful to keep the applicator from falling into the container when dipped in through an opening that accommodates end 221*a* but not end 221*b*. The dimensions of the applicator 219 allow the applicator to be used to apply adhesive in a variety of environments and spatial constraints. The embodiment of FIG. 3 is particularly desirable when the surface to be treated needs to be dried before the adhesive is applied. The wider end of the applicator can be used for drying the surface, and then the tapered end can be used to apply the adhesive, for example.

However, it should be recognized that the applicator 219 shown in FIG. 3 is only illustrative and not limiting. For example, the applicator may include only one absorbent end. Further, the absorbent end or ends of the applicator may be a wide variety of shapes and sizes such as circular, elliptical, elongated, curved or square depending on the particular application of the adhesive. Also, in embodiments, the absorbent end could be in the form of a brush and constructed of foam. For example, an elongated, absorbent end constructed of foam may be particularly useful in the application of adhesives to treat stomatitis.

Figure 5:
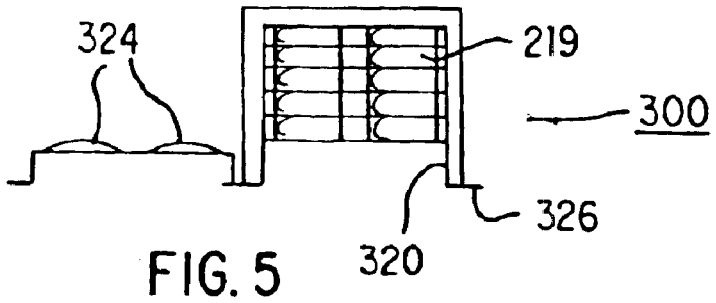
FIG. 5 is a side cross-sectional view of the package assembly of FIG. 4A along the line I—I.
Figure 4A:
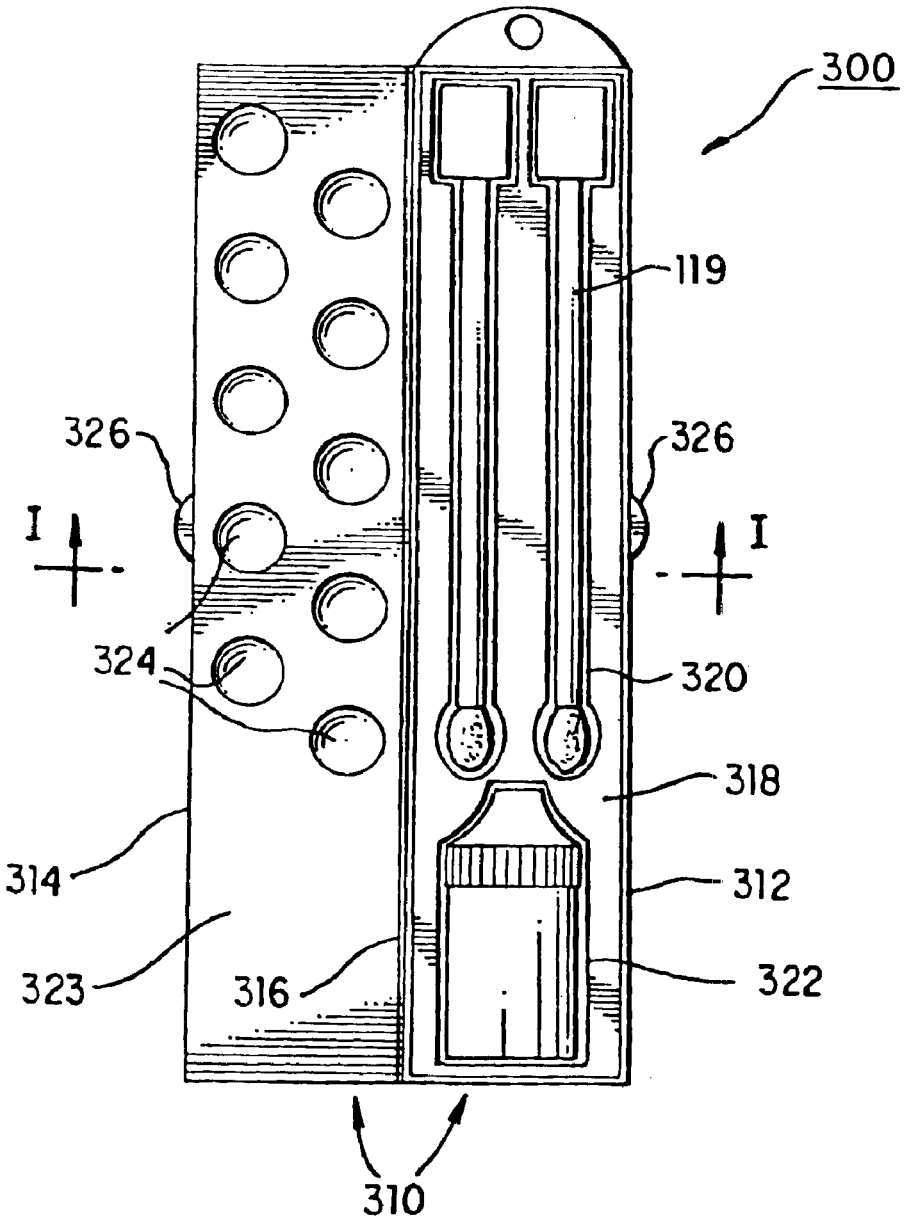
FIG. 4A is a top plan view of a package assembly including a cover with wells in accordance with embodiments of the invention.
Figure 4B:
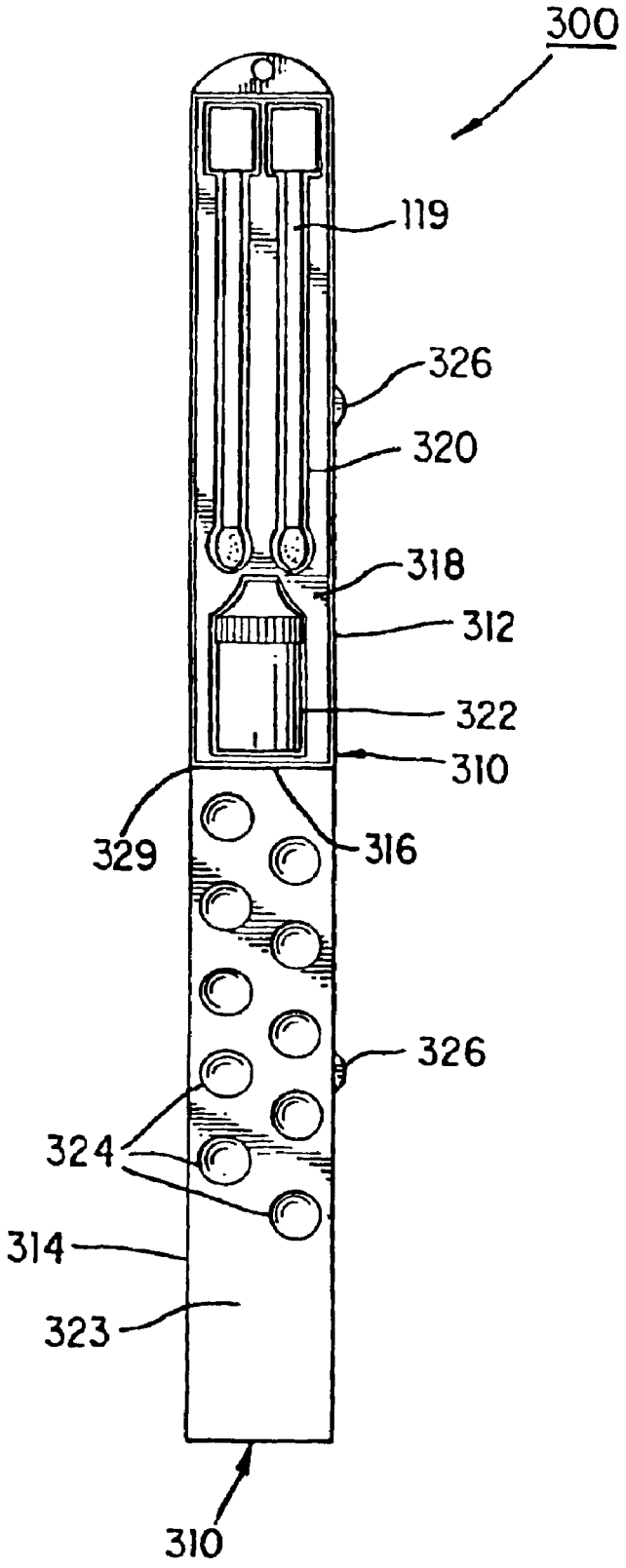
FIG. 4B is a top plan view of another package assembly including a cover with wells in accordance with embodiments of the invention.

FIGS. 4A, 4B and 5 show an enclosure or package assembly 300 in accordance with an embodiment of this invention. As shown in FIG. 4A, the package assembly 300 includes enclosure 310. Enclosure 310 includes a base 312 and a cover 314. The cover 314 is movably attached to the base 312. For example, the cover 314 may be pivotally attached to the base 312 using a hinge 316 or weakened portion.

The base 312 is elongated and includes a facing surface 318 and a plurality of cavities formed within the facing surface 318. Specifically, the base 312 includes a plurality of applicator cavities 320 and a single container cavity 322. The applicator cavities 320 are formed in the shape of an elongated slot and extend along the length of the base 312. A first and second applicator cavity 320 may be positioned side by side as shown in FIG. 4A. However, the invention is not limited to two adjacent applicator cavities 320. For example, a single cavity might be provided, in which applicators are positioned side by side.

The base 312 also includes the container cavity 322 positioned adjacent the applicator cavities 320. As shown in FIG. 4A, the container cavity 322 is positioned at one end of the applicator cavities 320 and centered relative to the width of the applicator cavities 320. The base 312 may be constructed using various constructs including a separate outer shell and inner shell, wherein the cavities are formed in the inner shell, for example. Alternatively, the base 312 may be constructed of a single unitary piece of material.

Further, the base 312 may contain an open cavity and an insert contained in the open cavity. The insert may include a plurality of dividers including slits and folds, for example, so as to form chambers in which to hold the container containing adhesive and the applicators, for example. The insert may be of any suitable material such as plastics, cardboard, paperboard or others. The invention is not limited to such an arrangement and the base 312 may be formed in a wide variety of arrangements so as to hold the contents thereof.

The container cavity 322 may hold the container 122, for example, shown in FIG. 1, as well as a wide variety of containers of different shapes, sizes and constructs. Further, it should be recognized that a wide variety of containers or receptacles may be used in embodiments of the invention. For example bottles with screw on lids, snap on lids, sealed pouches, or tubes may be used. For example, a foil tube similar to a traditional toothpaste container, preferably with a puncturable foil seal, may be utilized.

The cover 314 includes a cover surface 323. The cover 314 is movable between a first position, wherein the cover surface 323 opposes the facing surface 318 of the base 312, and a second position, wherein the cover surface 323 faces in the same direction as the facing surface 318. A plurality of wells 324 is disposed on the cover surface 323. Specifically, as shown in FIG. 4A, the wells 324 may be arranged in two sets of five, wherein the sets extend in a linear fashion along a portion of the length of the cover surface 323. However, the invention is not limited to such arrangement and the wells 324 may be arranged in a wide variety of arrangements. Further, the wells 324 may be concentrated along a certain portion of the cover 314, as shown in FIG. 4A. The wells 324 may be formed into any of a diverse variety of shapes. Illustratively, the wells 324 shown in FIG. 5 define the shape of a portion of a sphere. Alternatively, the wells could be oval, for example, or any other shape.

The wells 324 may be used in a plurality of manners. Illustratively, a user may apply a quantity of adhesive material onto an absorbent end 121 of a swab 119 by dripping the adhesive material from a bottle. However, a common problem with such a procedure is overdrip. Accordingly, the wells 324 serve as a reservoir to catch and retain drops resulting from overdrip. Alternatively, adhesive can be dispensed directly into the wells, and the applicator is then dipped into the wells. This can provide somewhat better control over the amount and location of adhesive on the applicator.

FIG. 4B shows another enclosure or package assembly in accordance with embodiments of the invention. Like reference numerals have been used in FIG. 4B, as in FIG. 4A, to designate like components. FIG. 4B illustrates that the cover 314 may be movably attached to the base 312 at an end 329, rather than a side, as shown in FIG. 4A. The arrangement shown in FIG. 4B is advantageous in that a user may easily hold the opened enclosure 310 using a single hand. However, it should be recognized that in accordance with the invention the interrelationship of the base 312 and the cover 314 is not limited to the arrangement shown in FIG. 4A or FIG. 4B, but rather may be a wide variety of shapes and designs.

FIG. 5 is a cross-sectional view of the package assembly 300 of FIG. 4A along the line I—I in FIG. 4A. FIG. 5 shows that the applicator cavity 320 may be provided with a sufficient depth so as to accommodate a plurality of applicators, such as swabs 219, for example. Illustratively, as shown in FIG. 5, five swabs 219 may be arranged in each applicator cavity 320. As described above, however, an alternative arrangement is to provide a single cavity, in which the applicators could be positioned side by side. In such an arrangement, for example, the single cavity might hold ten applicators. FIGS. 4A and 5 also show a latch 326 used in conjunction with the package assembly 300. The latch 326 may include first and second latch 326 portions. The latch 326 provides securement of the cover 314 in a closed condition. The specific construct of the latch 326 may be any of a wide variety of arrangements known in the art.

As shown in FIGS. 4A, 4B and 5, the applicator cavity 320 accommodates a plurality of swabs. However, it should be recognized that the swabs 119 may be positioned together in a single package or may be disposed individually in separate containers. For example, the swabs could be individually wrapped. Further, separate containers or packages containing individual swabs may in turn be disposed collectively in a larger container.

Figure 7:
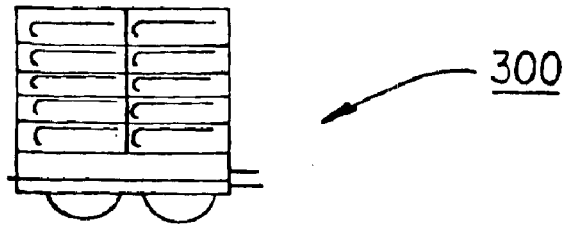
FIG. 7 is a side cross-sectional view of the package assembly of FIG. 6 along the line II—II.
Figure 6:
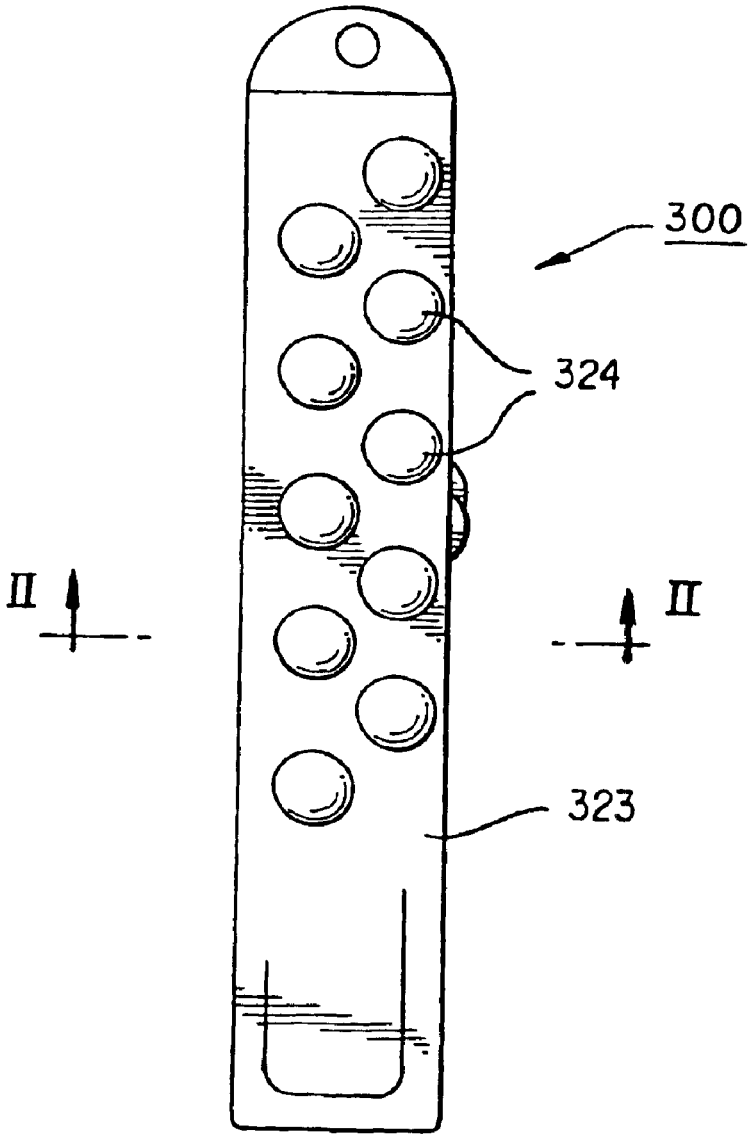
FIG. 6 is a top plan view of the package assembly of FIGS. 4A and 5 with the cover closed.

FIG. 6 is a top plan view of the package assembly 300 of FIGS. 4A and 5 with the cover 314 closed. Further, FIG. 7 is a cross-sectional view of the package assembly 300 of FIG. 6 along the line II—II, showing the cover 314 closed. Specific dimensions of the package assembly 300 of FIGS. 4A–7 may be widely varied depending on the particular application. However, illustratively, the package assembly 300 may be provided with a length of approximately six inches and a width and depth of approximately one inch.

Figure 8:
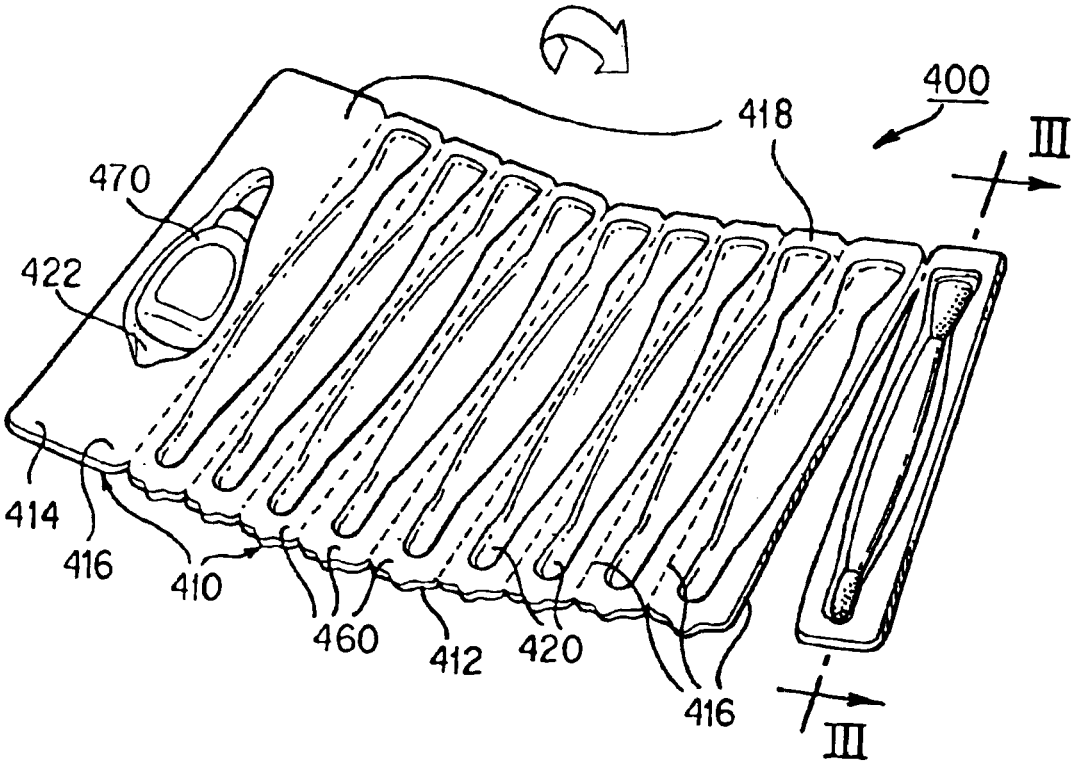
FIG. 8 is a perspective view of another package assembly in accordance with further embodiments of the invention.
Figure 9:
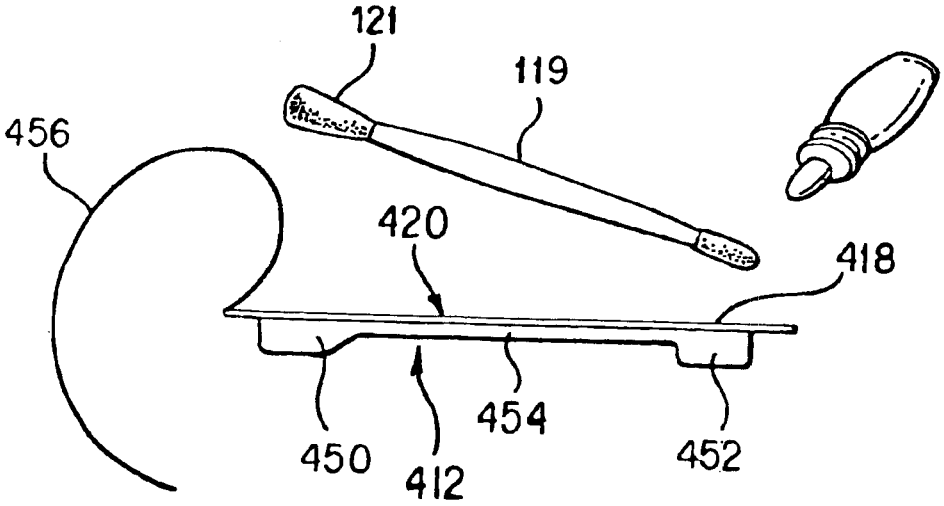
FIG. 9 is a side cross-sectional view of the package assembly of FIG. 8 along the line III—III.
Figure 10:
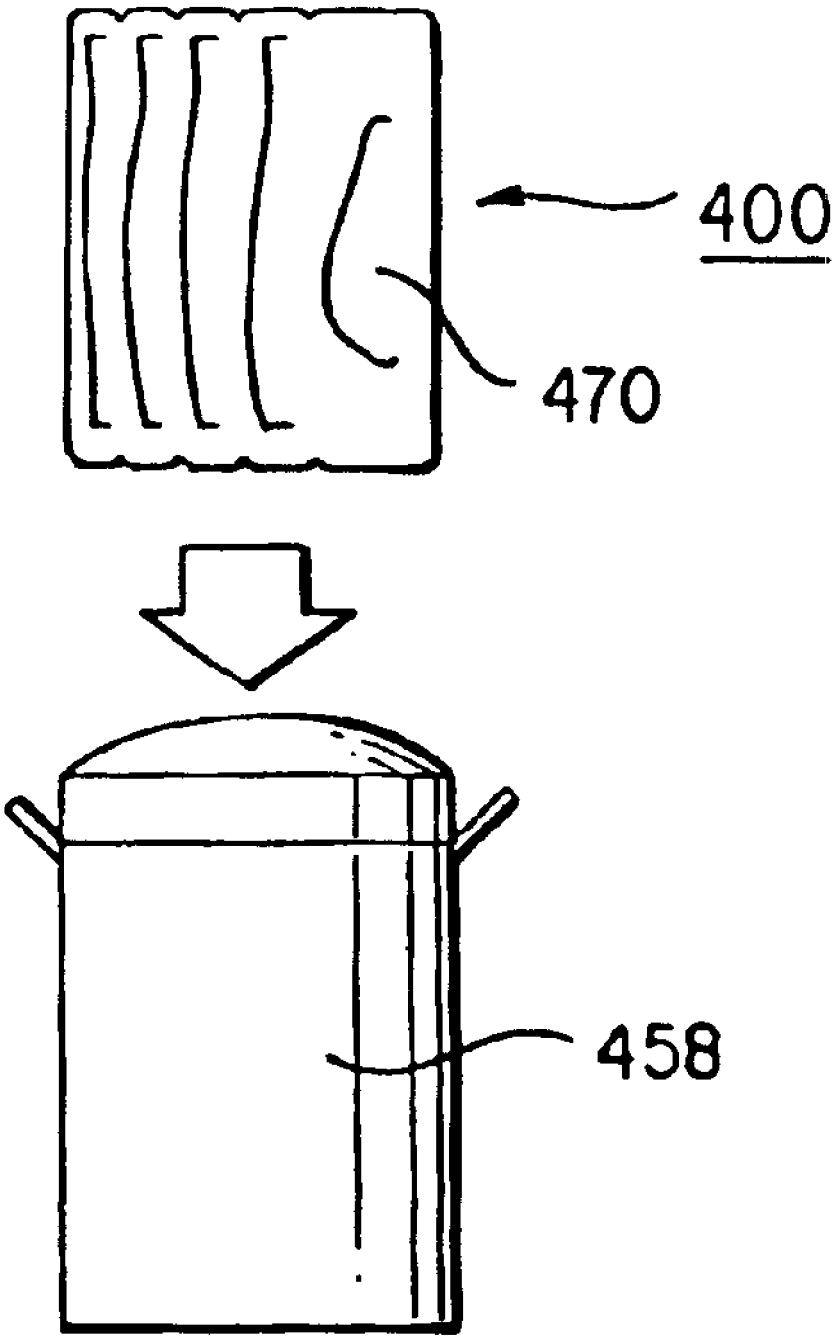
FIG. 10 is a top plan view of the package assembly of FIGS. 8 and 9 in conjunction with a carrying box.

FIGS. 8–10 show a package assembly 400 in accordance with another embodiment of the invention. As shown in FIG. 8, the package assembly 400 includes an enclosure 410 provided with cavities. The enclosure 410 includes an applicator portion 412 and a container portion 414. Further, the portions 412 and 414 may be separated by a hinge or a line of weakness defining a breaking line 416.

The applicator portion 412 includes a plurality of applicator cavities 420 as shown in FIGS. 8 and 9. FIG. 8 shows a package assembly 400 of the invention including ten applicator cavities 420. The applicator cavities 420 each include a first end and a second end. A connection portion 454 extends between the first end and the second end of the applicator cavities 420. A first well 450 is positioned at the first end of each applicator cavity 420. Also, a second well 452 is positioned at the second end of each applicator cavity 420.

Lower surfaces of the first well 450 and the second well 452, as well as the connection portion 454, define a depth relative to the facing surface 418. As is apparent from FIG. 9, the depth of the connection portion 454 is preferably less than the depth of each of the first and second wells 452. Further, the depth of the first well 450 may be greater than the depth of the second well 452. Accordingly, the applicator cavities 420 may be formed in this shape, or any other suitable shape, to accommodate a variety of applicators as well as to act as dip wells and/or drip wells for the adhesive.

The applicator cavities 420 may be separated into distinct cavity portions 460. A single cavity portion 460 includes a single applicator cavity 420 in accordance with a preferred embodiment of the invention. Each distinct cavity portion 460 is separated from an adjacent cavity portion by an additional line of weakening or breaking line 416. The breaking line 416 may be formed using a series of perforations or scoring, similar to the breaking line 416 separating the container portion 414 with the applicator portion 412.

An applicator including the ends 121 may be positioned within the first well 450, the connection portion 454, and the second well 452, as shown in FIG. 9. The applicator cavities 420 may be dimensioned to accommodate any of a wide variety of applicators with absorbent ends 121 which are the same in dimension or different.

A cover such as flexible cover 456 is removably positioned upon the facing surface 418 of the applicator portion 412 and/or the facing surface 418 of the container portion 414. For example, the flexible cover 456 may be laminated upon the package assembly 400 in such a manner that the cover 456 may be peeled back and separated from the facing surface 418. The cover 456 may be formed of cellophane or any other suitable material. The cover 456 in conjunction with the applicator portion 412 can provide each cavity with a seal to prevent the entry of extraneous materials.

The package assembly shown in FIGS. 8 and 9 preferably can be folded or rolled into a compact arrangement. Specifically, the breaking lines 416 can provide flexibility to the package assembly 400 to allow folding or rolling. Illustratively, the package assembly 400 may be folded so as to be inserted into a storage package 458 as shown in FIG. 10.

Figure 11:
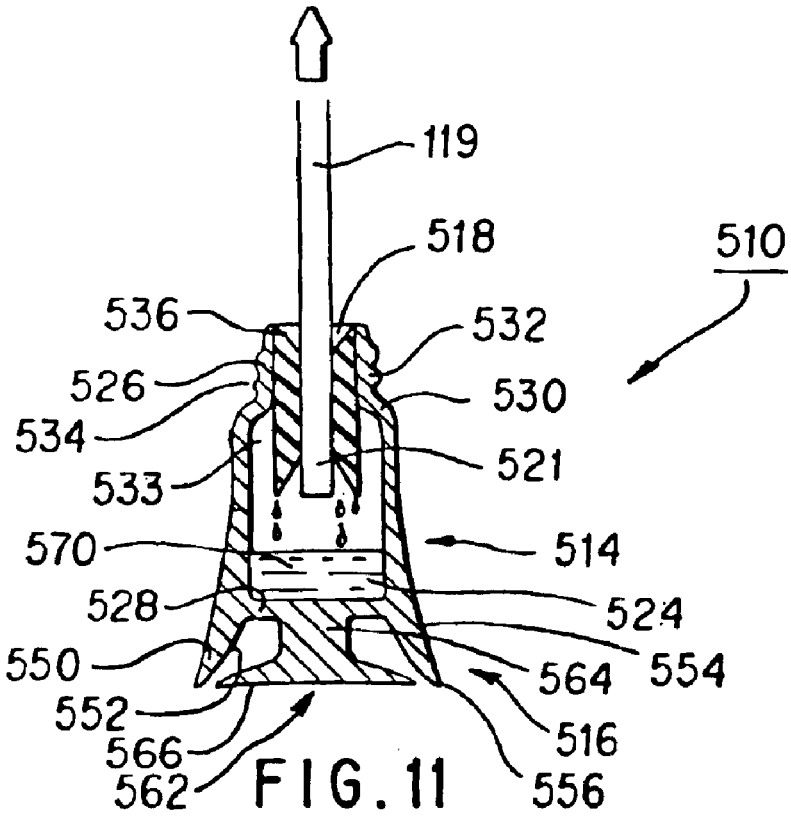
FIG. 11 is a side cross-sectional view of a receptacle assembly according to embodiments of the invention.
Figure 12:
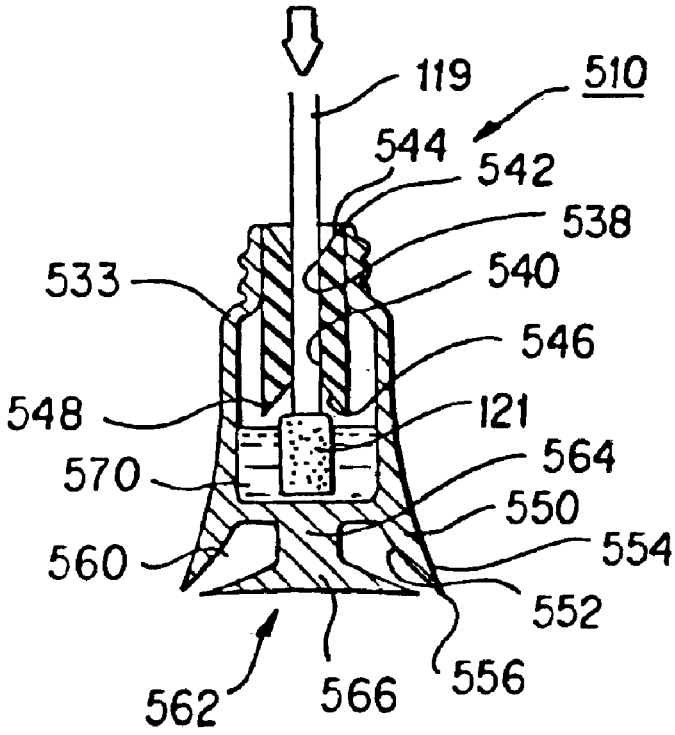
FIG. 12 is a side cross-sectional view of the receptacle assembly of FIG. 11 at a time previous to that shown in FIG. 11.

FIGS. 11 and 12 show a container assembly 510 in accordance with preferred embodiments of this invention. As shown in FIGS. 11 and 12, the container assembly 510 includes a vessel 514, a base 516 and a restrictor 518. The vessel 514 may be formed integral with or removably attachable to the base 516. Further, the restrictor 518 is positioned within vessel 514. An applicator such as a swab 219, as shown in FIG. 3, with an absorbent end 221 may be inserted into and withdrawn from the vessel 514 through the restrictor 518 as shown in FIGS. 11 and 12, respectively.

The base 516 serves to support the receptacle 514 in an upright position to provide access to the interior of the receptacle 514 through the restrictor 518.

The vessel 514 includes an internal lumen 524 and a neck 526. The internal lumen 524 defines a substantially cylindrical or other shape interior including bottom 528 and annular shoulder 530 disposed at the top 532 of the vessel 514 as shown in FIG. 11. The shoulder 530 serves to provide a smooth transition between the interior surface of the internal lumen 524 and the interior surface of the neck 526. It also provides an area 533 into which adhesive material 570 can flow without spilling when the container is tilted. An exterior surface of the neck 526 may include a connecting arrangement 534, including, but not limited, to threads, rings, catches or snaps, for example. The neck 526 includes an uppermost planer surface which forms a rim defining an opening 536. The opening 536 is closable using an appropriately shaped stopper or cap.

In accordance with the invention, the restrictor 518 is positioned within the neck of the vessel 514. The restrictor 518 is preferably substantially cylindrical in shape and includes a central passage 540 extending along the length and through the center of the restrictor 518. The interior of the restrictor 518 includes an interior surface 538 that forms the central passage 540. Further, the restrictor 518 includes a top surface 542. An annular tapered surface 544 can provide a transitional surface between the top surface 542 and the interior surface 538 of the restrictor 518. A lower tapered surface 546 can provide a transitional surface between the restrictor interior surface 538 and the lower end 548 of the restrictor 518, as shown in FIGS. 11 and 12.

A suction cup 566 may be mounted on the lower end of center support 564. The suction cup 566 provides a secure attachment of the receptacle assembly 510 to a supporting surface. As a result, the receptacle assembly 510 of the invention provides for one handed use, thus allowing a user's free hand to hold the object upon which the adhesive material is to be applied, for example. Such is particularly useful in a medical or specifically surgical environment.

Particularly in combination with use of a suction cup, base 516 preferably includes at least one extension that stabilizes the container on a surface. The extension may be in the form of a skirt 550. The skirt 550 extends downwardly from the receptacle bottom 528 and is formed into an annular tapered shape. As shown in FIGS. 11 and 12, the skirt 550 includes an inner skirt surface 552 and an outer skirt surface 554. The inner skirt surface 552 and the outer skirt surface 554 may be tapered toward each other towards a common contact supporting rim 556. The contact supporting rim 556 is positioned on a supporting surface during use of the container assembly 510. The contact supporting rim 556 contacts the supporting surface in a manner such that the container assembly 510 is stabilized during use.

The container assembly 510 including the base 516 with skirt 550, as well as the restrictor, may be formed of any of a wide variety of materials including but not limited to polymerized materials such as plastics, foams, rubbers, thermoplastics, thermosets, metals, for example, or any other suitable material. In general, the only limitation on the materials used to fabricate them is that the material must be sufficiently compatible with the composition to be dispensed that undesirable effects on the composition do not occur during contact of the composition with the receptacle and the restrictor.

Further, while the skirt 550 was described as having a annular shape, the skirt 550 is not limited to such shape.

Rather, the skirt 550 could be a variety of shapes, including, but not limited to, conical, cylindrical, polygonal, or include a plurality of supports or a segmented annular arrangement, for example.

Illustratively, a process of dispensing and applying an adhesive in conjunction with the assembly 510 of the invention will hereinafter be described. The container assembly 510 is used in conjunction with an applicator such as a swab shown in FIG. 3, for example. The specific dimensions of the swab should be compatible with the dimensions of the restrictor 518.

When a user desires to apply an adhesive material to the swab 119, an absorbent end 121 may be maneuvered into the upper tapered surface of the restrictor 518 and pushed through the restrictor passage 540. In this manner, the swab 119 is inserted into the vessel 514 through the restrictor 518. The diameter of the restrictor interior surface 538 is slightly less than the uncompressed outer diameter of the absorbent end 121 of the swab 119. As a result, as the swab 119 is passed through the restrictor 518, the material of the absorbent end 121 of the swab 119 is compressed. Once the absorbent end 121 is fully inserted into the vessel 514, the absorbent end 121 is submersed or partially submersed in adhesive material 570. Thereafter, the user withdraws the absorbent end 121 of the swab 119 from the vessel 514 back through the restrictor 518. As the swab 119 is withdrawn through the restrictor 518, the swab 119 will again be compressed. As a result, a portion of the adhesive material 570 which was absorbed and retained by the swab 119 will be forced out of the swab 119 and will drip back into the internal lumen 524 of the vessel 514. As a result, the volume content of the adhesive material 570 retained in the absorbent end 121 after the swab 119 is fully withdrawn from the receptacle assembly 510 may be accurately controlled.

As a user withdraws the swab. 119, an upward force will be exerted on the receptacle container assembly 510. The suction cup 566 may be provided, as described above, to retain the receptacle assembly 510 on a supporting surface. Further, an upward force will be exerted on the restrictor 518 so as to tend to separate the restrictor 518 from the vessel 514. However, the restrictor 518 may be retained within the neck 526 using any known method such as well known adhesives or a friction fit, for example.

It should be recognized that in embodiments, the adhesive and other components may be sterilized. For example, the adhesive material 570 shown in FIG. 11 may be sterilized. Further, the assembly 510 including the vessel 514, the restrictor 518 and the swab 119 may also be sterilized. The assembly 510 may be sterilized by the same or a different method as that used for the adhesive material 570. Further the separate components of the assembly 510 may be sterilized by different methods. Also, the package assembly or kit 100, shown in FIG. 1, may be sterilized as well as the adhesive contained therein.

In embodiments, various sterilization processes may be used. Examples include, but are not limited to, chemical sterilization (e.g., with ethylene oxide or hydrogen peroxide vapor), physical sterilization (e.g., dry heat) or other techniques such as microwave irradiation, gamma radiation, and ionizing radiation. Especially useful methods for sterilizing include electron beam irradiation, such as the method disclosed in co-pending U.S. patent application Ser. No. 09/025,472, the disclosure of which is hereby incorporated by reference in its entirety.

Figure 13:
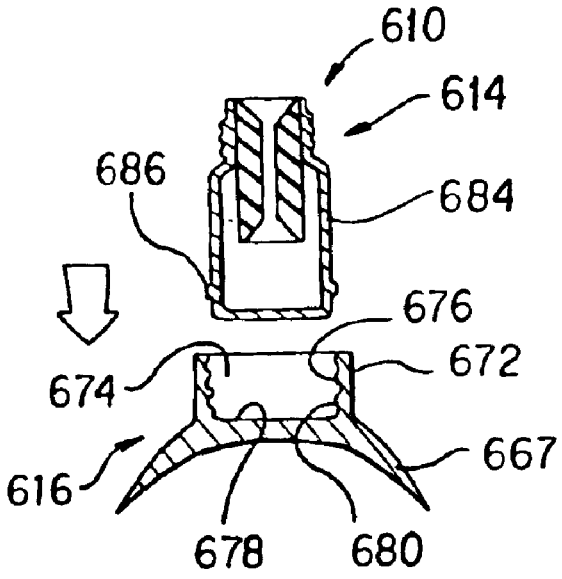
FIG. 13 is a side cross-sectional view of a receptacle assembly in accordance with further embodiments of the invention.
Figure 14:
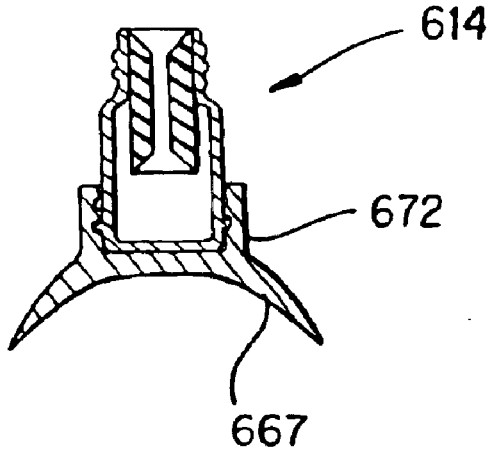
FIG. 14 is a side cross-sectional view of the receptacle assembly of FIG. 13 showing a receptacle and connected base.

FIGS. 13 and 14 show an embodiment of a container assembly 610 in accordance with the invention. In this embodiment, the vessel 614 and the base 616 are not integrally formed. Rather, they are removably connected through the use of a locking retainer 672.

Specifically, the base 616 includes the locking retainer 672 and a suction cup 667 at the lower portion of the locking retainer 672. Illustratively, the locking retainer 672 includes a receiving cavity 674 and a locking channel 676. The receiving cavity 674 includes a lower circular surface 678 and a retainer interior surface 680. The locking channel 676 is formed in the retainer interior surface 680 of the receiving cavity 674. Further, an outer surface of the vessel 614 is formed with a locking ring 686. In the embodiment shown in FIG. 13, the locking ring 686 extends fully around the exterior of the vessel 614. However, such arrangement is not necessary and the locking ring 686 could be segmented, or extend around only a portion of the vessel 614, for example. Further, the locking channel 676 could be segmented or only partially extend around the retainer interior surface 680, for example. FIG. 13 shows the vessel 614 and the base 616 in a separated condition.

Provided the relative positioning as shown in FIG. 13, upon movement of the vessel 614 downward, it passes into the receiving cavity 674 of the base 616. The vessel 614 is guided into the base 616 by the retainer interior surface 680 of the receiving cavity 674. After sufficient downward movement, the bottom surface of the vessel 614 may contact and be supported by the lower surface of the receiving cavity 674, as shown in FIG. 14. At the same time, the locking ring 686 will be opposed to locking channel 676 and will pass into and mate with the locking channel 676. As a result, the vessel 614 will be removably secured to the base 616.

Figure 15:
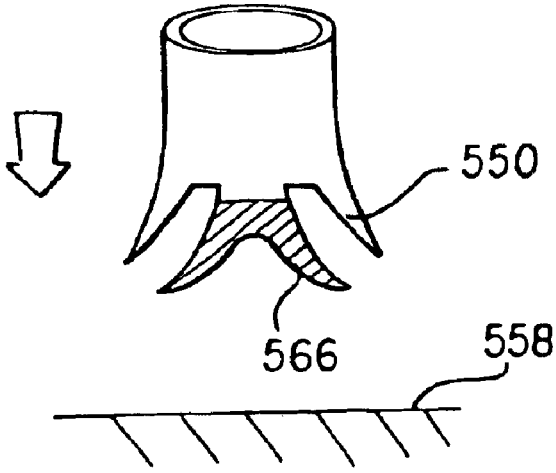
FIG. 15 is a side cross-sectional view of a lower portion of a receptacle assembly in accordance with the invention.

FIG. 15 illustrates an operation to mount the assembly 510 of FIG. 11, for example, upon a supporting surface 558 in accordance with the invention. The assembly may be supported upon a smooth surface upon which it is desirable or necessary to support the assembly. The user exerts a downward pressure on the assembly so as to resiliently bend the suction cup 566 and secure the suction cup 566 to the surface, as is well known in the art.

Further, the skirt 550 of the assembly 510 may be somewhat resilient. As a result, downward pressure of the assembly results in slight deformation of the skirt 550. This deformation will occur as the suction cup 566 is being pressed upon the supporting surface 558. The user will release the assembly after the suction cup 566 is sufficiently deformed. Thereafter, due to the resilience of suction cup 566, the suction cup 566 will move to some extent back to the undeformed condition shown in FIG. 15 until the force applied by the suction is equivalent to force exerted due to the resilience of the suction cup 566. As a result, the skirt 550 may be maintained in a somewhat deformed condition and a state of tension is provided between the skirt 550 and the force exerted by the suction cup 566. Accordingly, stability of the assembly is enhanced.

While this invention has been described in conjunction with specific embodiments outlined above, it is evident that many alternatives, modifications and variations may be apparent to those skilled in the art. For example, various different combinations, and shapes, sizes and arrangements, of the described features are contemplated. Accordingly, the preferred embodiments of the invention as set forth herein are intended to be illustrative, not limiting. Various changes may be made without departing from the spirit and scope of the invention.

What is claimed is:

1. A method for applying an adhesive material to a surface to be treated, the method comprising the steps of:

providing an applicator comprising at least one absorbent portion, said absorbent portion comprising an exterior surface;

providing an adhesive material, said adhesive material comprising 1,1-disubstituted ethylene monomers;

applying the adhesive material to the exterior surface of said absorbent portion so that the adhesive material is then absorbed into the absorbent portion of said applicator;

applying said adhesive material to said surface to be treated by contacting said absorbent portion with said surface to be treated;

further comprising exposing the exterior surface of the absorbent portion to atmosphere prior to applying the adhesive material to the exterior surface.

2. The method according to claim 1, wherein the surface to be treated is living tissue.

3. The method according to claim 1, wherein at least the adhesive material is sterilized.

4. The method according to claim 3, wherein the applicator and adhesive material are sterilized.

* * * * *